US011299908B2

(12) United States Patent
Miyagi et al.

(10) Patent No.: US 11,299,908 B2
(45) Date of Patent: Apr. 12, 2022

(54) FENCE

(71) Applicant: SEKISUI HOUSE, LTD., Osaka (JP)

(72) Inventors: Aya Miyagi, Osaka (JP); Hiroyuki Suitsu, Osaka (JP); Yoichi Kobayashi, Osaka (JP); Makoto Nakatani, Osaka (JP); Eiji Yoshida, Tokyo (JP)

(73) Assignee: SEKISUI HOUSE, LTD., Osaka (JP)

( * ) Notice: Subject to any disclaimer, the term of this patent is extended or adjusted under 35 U.S.C. 154(b) by 145 days.

(21) Appl. No.: 16/919,637

(22) Filed: Jul. 2, 2020

(65) Prior Publication Data

US 2021/0025192 A1 Jan. 28, 2021

(30) Foreign Application Priority Data

Jul. 2, 2019 (JP) ..... JP2019-123972

(51) Int. Cl.
*E04H 17/00* (2006.01)
*E04H 17/14* (2006.01)

(52) U.S. Cl.
CPC ..... *E04H 17/003* (2013.01); *E04H 17/1413* (2013.01)

(58) Field of Classification Search
CPC ... E04H 17/003; E04H 17/14; E04H 17/1413; E04H 17/1452
See application file for complete search history.

(56) References Cited

U.S. PATENT DOCUMENTS 2,906,506 A * 9/1959 Barnes ..... E04H 17/1413 256/19
2,927,779 A * 3/1960 Umberger ..... E04H 17/20 256/19
3,963,219 A * 6/1976 D'Amico ..... E04H 17/1413 256/24
4,498,660 A * 2/1985 Brema ..... E04H 17/1404 256/12.5
D528,668 S * 9/2006 Wyatt ..... D25/126

FOREIGN PATENT DOCUMENTS

GB 2374880 A * 10/2002 ..... E04H 17/1413
JP 2004-60272 A 2/2004

* cited by examiner

*Primary Examiner* — Jonathan P Masinick
(74) *Attorney, Agent, or Firm* — Birch, Stewart, Kolasch & Birch, LLP.

(57) ABSTRACT

Provided is a fence which can prevent a person from clambering over the fence while ensuring sufficient ventilation. The fence includes: a plurality of posts; a pair of plate members extending in a horizontal direction and spaced away from each other in a vertical direction; and a blocking member arranged in the space between the plate members for keeping a foot of a person from entering the space between the plate members to prevent the person from clambering over the fence, wherein a lower end of the blocking member is spaced upward from the plate member at a lower position, and defines a lower gap against an upper surface of the plate member at the lower position, the lower gap having such a dimension as to keep a tip of the foot of the person from entering the lower gap.

15 Claims, 11 Drawing Sheets

FENCE

TECHNICAL FIELD

The present invention relates to a fence having a gap for ventilation.

BACKGROUND ART

A wide variety of fences for each partitioning a predetermined place into an area on inside and an area on outside includes a balcony balustrade, a fence surrounding a garden, and the like.

For instance, various balcony balustrades each installed in a standing state along a periphery of a balcony have been proposed to have a configuration for ensuring sufficient ventilation.

Japanese Unexamined Patent Publication No. 2004-60272 discloses, for example, a balcony balustrade including a pair of posts spaced away from each other, and a plurality of quadrangular members extending between the posts in a horizontal direction and spaced away from one another in a vertical direction. The plurality of quadrangular members extending in the horizontal direction define a space therebetween, and hence the balustrade can ensure sufficient ventilation.

Moreover, two vertically adjacent quadrangular members have opposing surfaces which face each other in the vertical direction, the opposing surfaces inclining upward or downward with respect to the horizontal direction as advancing from a balcony outside to a balcony inside. Accordingly, the space between the opposing spaces decline with respect to the horizontal direction as well. The balustrade having this configuration makes an area on the balcony inside invisible from an area on the balcony outside through the space.

However, the balcony balustrade disclosed in Japanese Unexamined Patent Publication No. 2004-60272 has a risk that a person would clamber over the balustrade by inserting a toe, a finger and the like into the space between the quadrangular members if the dimension of the space is increased to ensure the sufficient ventilation. Particularly, a child (more specifically, a three to six-year-old child) has a thinner toe and a thinner finger, and thus can easily insert the toe and the finger into the space of the balustrade, resulting in increasing the risk of the clambering over the balustrade. The clambering of the child over the balustrade would lead to an accident of his/her falling-down from the balcony, and hence a countermeasure for preventing the clambering over the fence is needed.

Under the circumstances, a prospected countermeasure for preventing the clambering includes closing the space from the balcony inside by a sheet-like member, such as a perforation metal member, having a plurality of pores for ventilation, thereby keeping the toe and the like from entering the space. In this case, however, the sheet-like member such as the perforation metal member decreases the ventilation of the balustrade.

An object of the present invention is to provide a fence which can prevent a person from clambering over the fence while ensuring sufficient ventilation.

SUMMARY OF INVENTION

To solve the aforementioned problem, a fence according to the present invention is installed in a standing state for partitioning a predetermined place into an area on inside and an area on outside, the fence including: a plurality of posts; a pair of plate members extending between the plurality of posts in a horizontal direction and fixedly attached to the plurality of posts, the pair of plate members being spaced away from each other in a vertical direction; and a blocking member arranged in the space between the plate members for keeping a foot of a person from entering the space between the plate members to prevent the person from clambering over the fence, wherein a lower end of the blocking member is spaced upward from the plate member at a lower position, and defines a lower gap against an upper surface of the plate member at the lower position, the lower gap having such a dimension as to keep a tip of the foot of the person from entering the lower gap.

DESCRIPTION OF EMBODIMENTS

Figure 1:
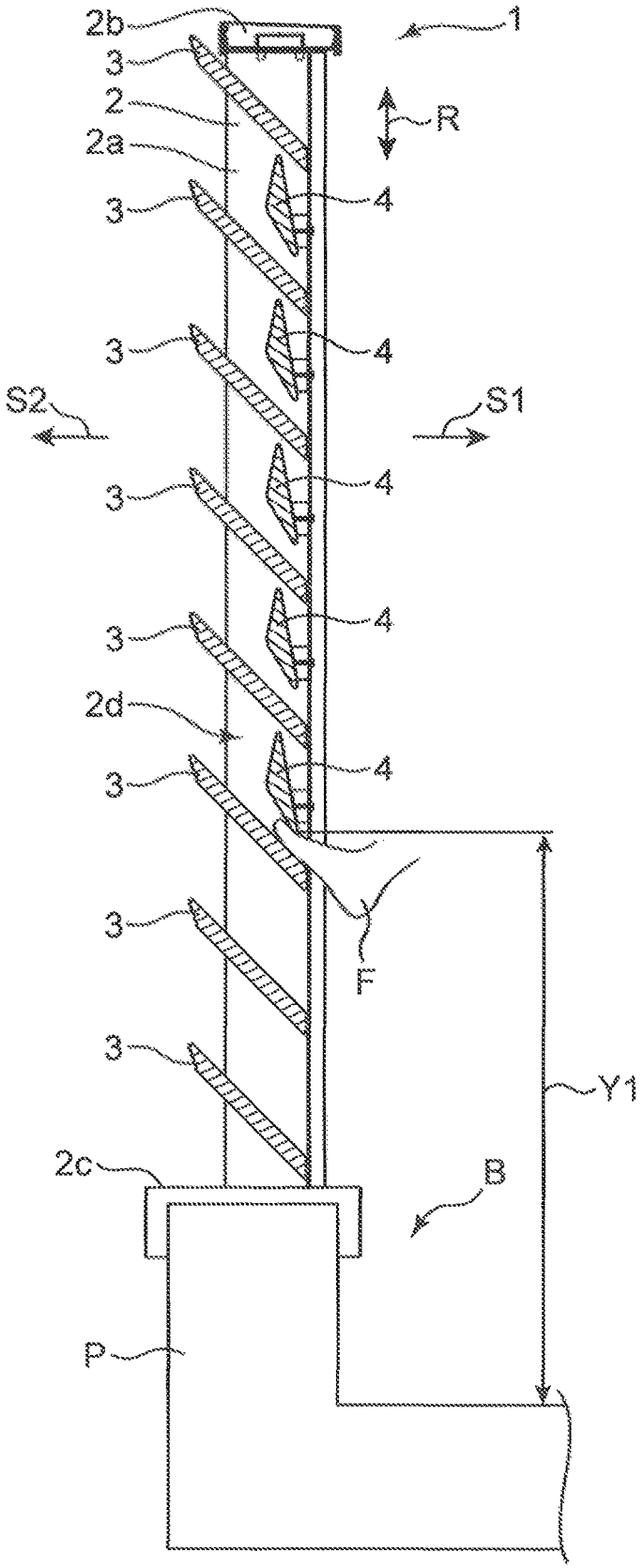
FIG. 1 is a longitudinal cross-sectional view of a balcony balustrade installed at a balcony as an exemplary fence according to an embodiment of the present invention.
Figure 2:
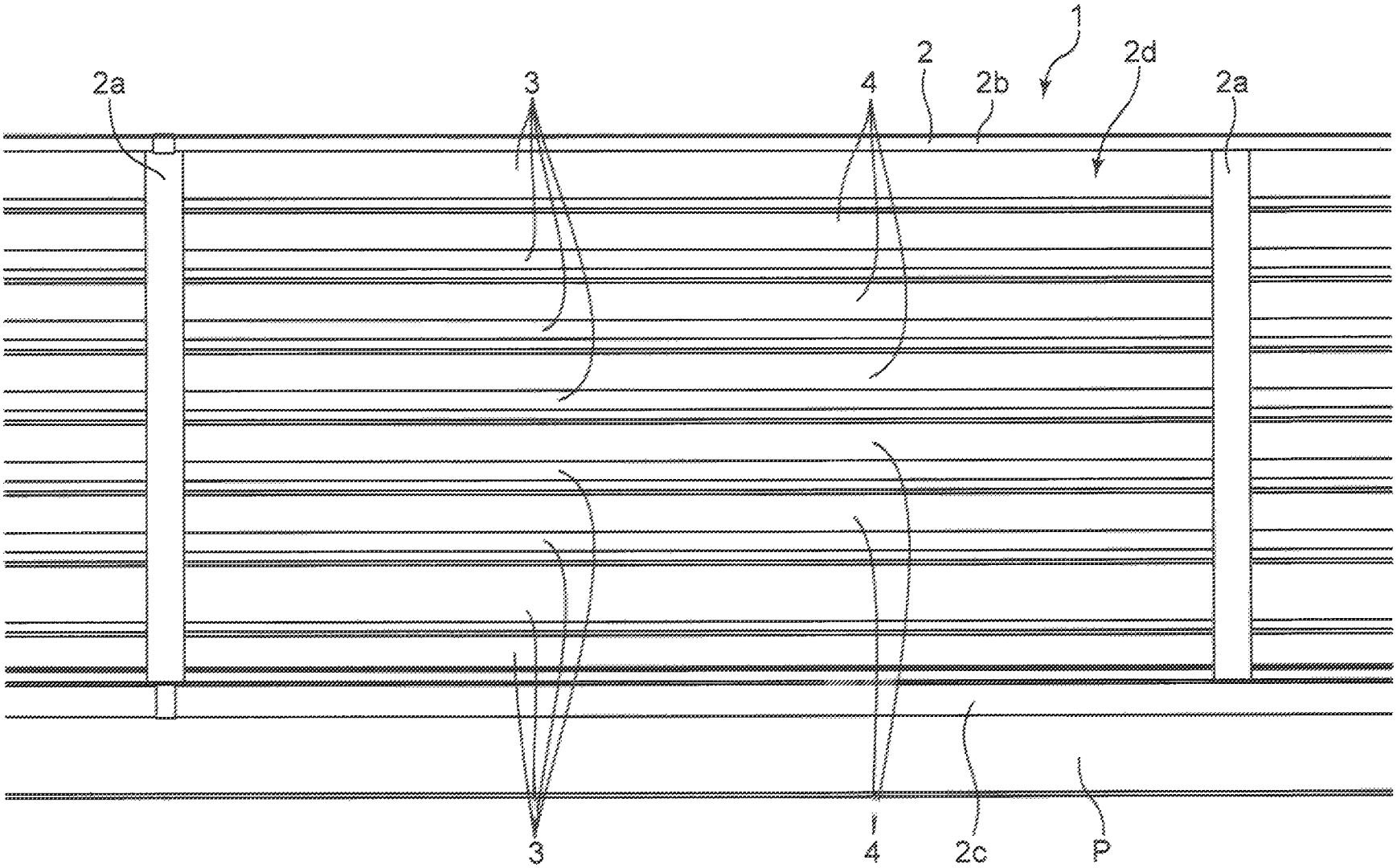
FIG. 2 shows the balcony balustrade of FIG. 1 seen from a balcony inside.

Hereinafter, preferred embodiments of the present invention will be described with reference to the accompanying drawings. As shown in FIGS. 1 and 2, a balcony balustrade 1 which is an exemplary fence according to an embodiment of the present invention is installed in a standing state for partitioning a predetermined place into an area on inside and an area on outside. Specifically, the balcony balustrade 1 is installed in a standing state on a beam P along a periphery of a balcony B protruding outward from an outer wall (specifically, protruding outward from a window on a second or higher floor) or a veranda of a building such as a house and an apartment. The balcony balustrade 1 installed in this manner can serve as a fence for prevention of falling-down from the balcony B, and as an exterior ornament decorating the balcony B.

The balcony balustrade 1 shown in FIG. 1 includes a frame 2 having a pair of posts 2*a*, a plurality of plate members 3 extending in a horizontal direction, and a blocking member 4 arranged in a space between the plate members 3 for keeping a foot F from entering the space between the plate members 3 to prevent the clambering over the balustrade 1.

The frame 2 includes the pair of posts 2*a* spaced away from each other in the horizontal direction, a coping 2*b* connecting upper ends of the posts 2*a* with each other, and a connecting member 2*c* connecting lower ends of the posts 2*a* with each other. The pair of posts 2*a*, the coping 2*b*, and the connecting member 2*c* define a rectangular opening 2*d* thereamong.

The pair of posts 2*a* and the connecting member 2*c* are fixedly attached to a top of the beam P along the periphery of the balcony B.

In the opening 2*d*, the plurality of plate members 3 extend in the horizontal direction and are fixedly attached to the pair of posts 2*a*, the plate members 3 being spaced away from one another in a vertical direction R.

Figure 3:
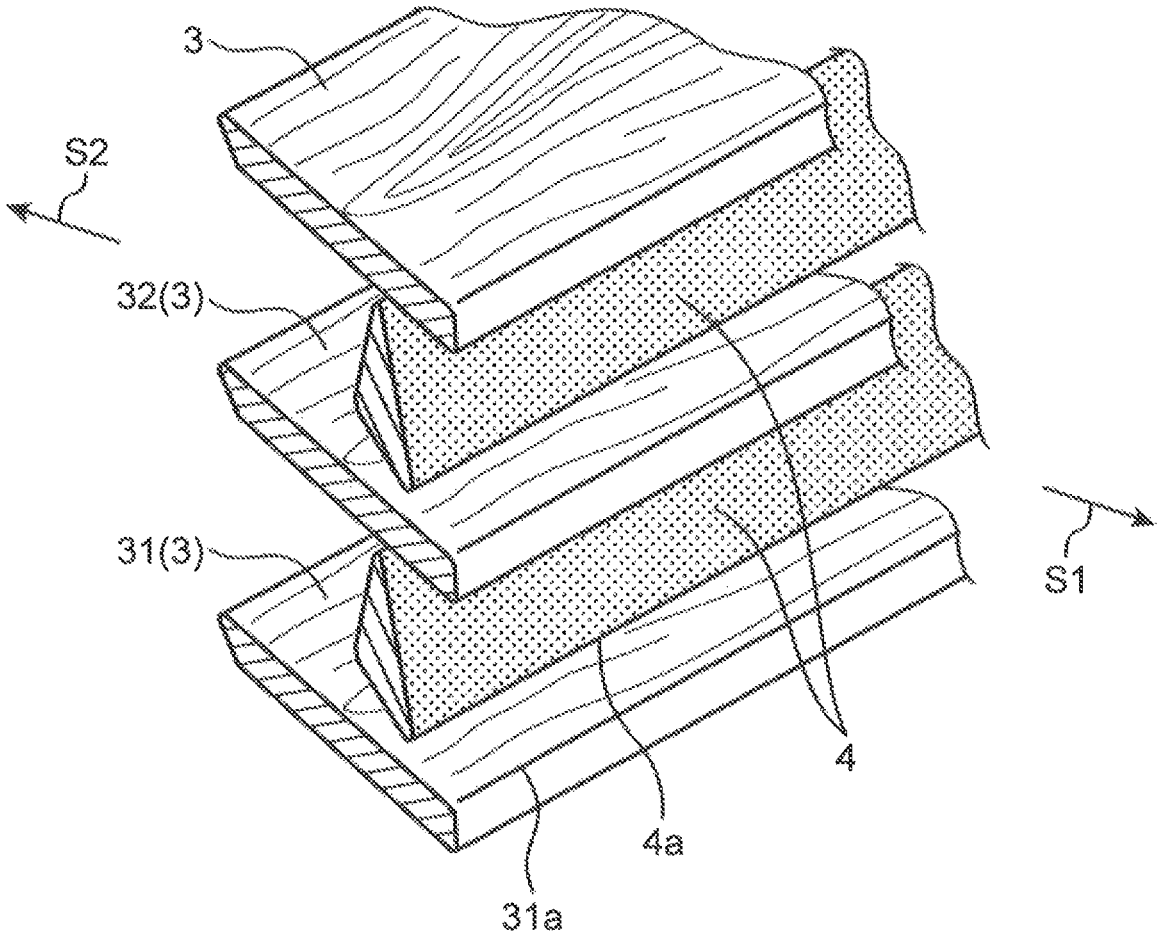
FIG. 3 is an explanatory perspective view illustrating a state where a blocking member shown in FIG. 1 is invisible on an inner side in a space between plate members.
Figure 4:
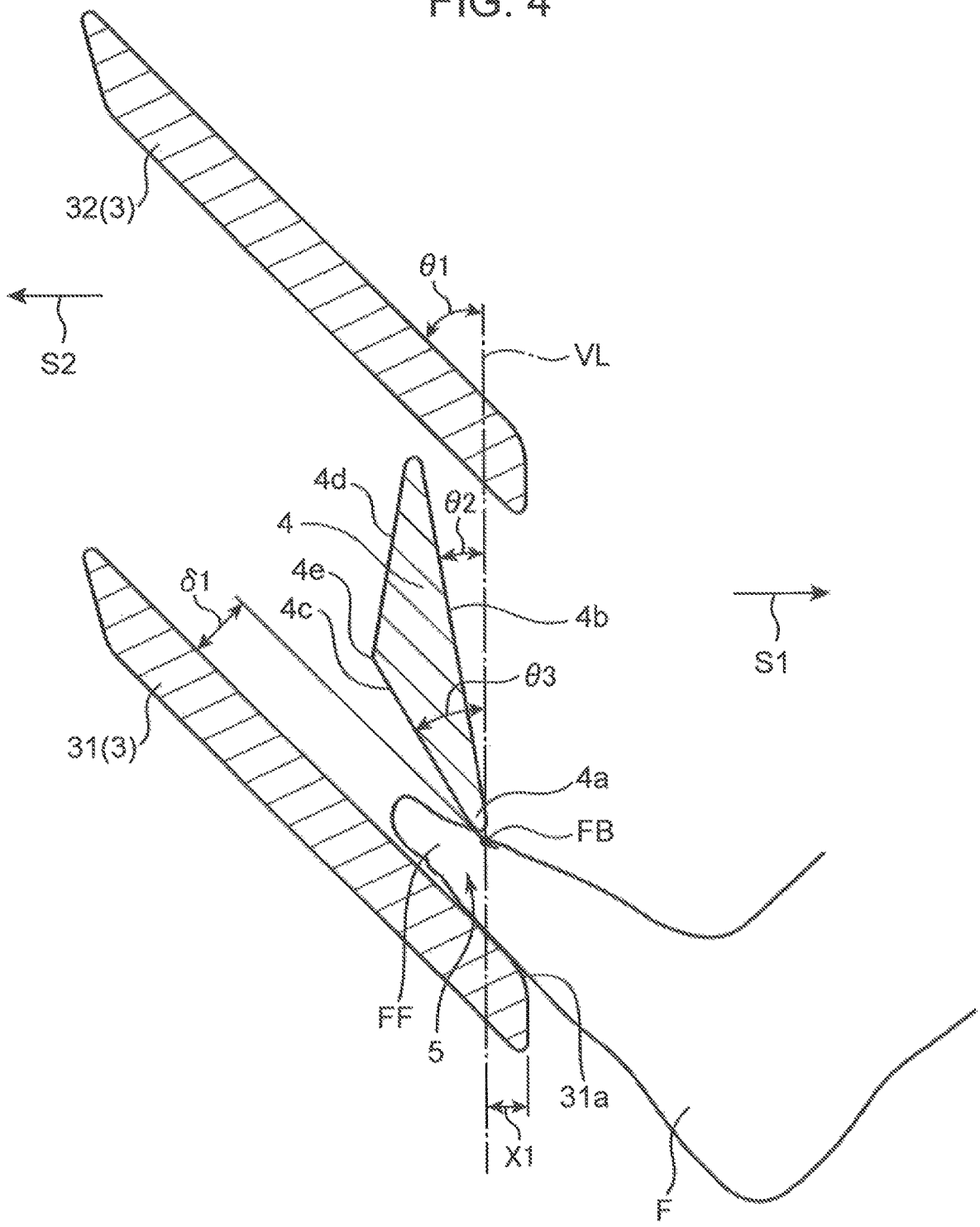
FIG. 4 is an enlarged cross-sectional view showing a state where the blocking member is arranged between a pair of plate members shown in FIG. 1 for keeping a foot from being put on the plate member at a lower position.

In the embodiment, for explanation of the plate members 3 and the blocking member 4 in association with each other, the plate member 3 at a lower position of the blocking member 4 is referred to as "plate member 31", and the plate member 3 at a higher position of the blocking member 4 is referred to as "plate member 32" distinctively as shown in FIGS. 3 and 4. Specifically, in the embodiment, one blocking member 4 is arranged between a pair of upper and lower plate members 3 (i.e., the "lower plate member 31" and the "upper plate member 32").

The plate members 3 incline downward from a balcony outside S2 (i.e., "outside" of a predetermined place) to a balcony inside S1 (i.e., "inside" of the predetermined place) in the opening 2*d*. As shown in FIG. 4, an inclination angle θ1 of each of the plate members 3, that is, an angle θ at which the plate member 3 intersects a vertical plane VL, is preferably set in such a manner that the foot F even put on the plate member 3 is easily slipped off from the plate member 3, and that the balcony inside S1 is invisible from the balcony outside S2 through the space between the plate members 3. From this perspective, the angle θ1 is preferably set at around 45°. Meanwhile, the plate member 3 can be at a desired inclination angle θ1, for example, preferably at an acute angle, specifically, at the angle θ1 of less than 90°, and more preferably, at the angle θ1 of 0° to 45° rather than in a horizontal arrangement.

It is noted here that the horizontal arrangement at the angle θ1 of 90° is also adaptable. Even in this case, the blocking member 4 arranged between the pair of plate members 3 in the embodiment makes it possible to prevent the clambering over the balcony balustrade 1.

The blocking member 4 in the embodiment is a plate-like member having a triangular cross-sectional shape. The blocking member 4 having the triangular cross-sectional shape has a first surface 4*b*, a second surface 4*c*, and a third surface 4*d*.

The first surface 4*b* faces the balcony inside S1. The first surface 4*b* interests the vertical plane VL at an angle θ2 smaller than the angle θ1 (e.g., around 45°) between the plate member 3 and the vertical plane VL. The first surface 4*b* in this state is unlikely to receive the foot F thereon, thereby rendering the clambering over the balustrade 1 more unsuccessful. The first surface 4*b* preferably intersects the vertical plane VL at the angle θ2 closer to the vertical (closer to 0°) but slightly inclines from the vertical plane VL to keep the foot F from being easily put on the first surface 4*b* and allow the first surface 4*b* to fall in a shade of an end part of the upper plate member 32 on the balcony inside S1. In this respect, the angle θ2 may be set at, for example, around 10°.

The second surface 4*c* faces the balcony outside S2, the second surface 4*c* inclining toward the balcony outside S2 as advancing upward from a lower end 4*a* of the blocking member 4. The second surface 4*c* of the blocking member 4 in this state is unlikely to receive a finger HF shown in FIGS. 6 and 7 thereon. The second surface 4*c* preferably intersects the vertical plane VL at an angle θ3, e.g., 30°, to keep the finger HF from easily holding the second surface 4*c*.

The third surface 4*d* faces the balcony outside S2, the third surface 4*d* extending toward the balcony inside S1 as advancing upward from an upper end of the second surface 4*c*.

The blocking member 4 is arranged in the space between the plate members 3 for keeping the foot F of the person from entering the space between the plate members 3.

Specifically, as shown in FIGS. 3 and 4, the lower end 4*a* of the blocking member 4 is spaced upward from the lower plate member 31, and defines a lower gap 5 against the lower plate member 31. The lower gap 5 has such a dimension δ1 as to keep a tip (specifically, a toe FF) of the foot of the person from entering the gap between the lower end 4*a* of the blocking member 4 and an upper surface of the lower plate member 31.

The balustrade 1 according to the embodiment is designed by presuming the "person" to be a three to six-year-old child who is highly likely to clamber over the balustrade 1 and fall down from the balcony B. Under the presumption, the lower gap 5 has such a dimension δ1 as to keep the tip (the toe FF) of the foot or other body portion of the three to six-year-old child that may enable the clambering from entering the lower gap 5.

Figure 5:
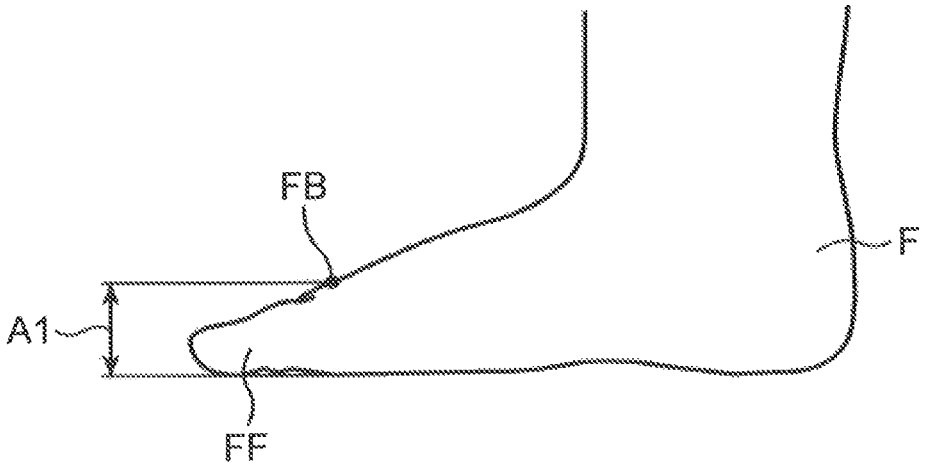
FIG. 5 is an explanatory view explaining a ball height of the foot shown in FIG. 4.

Specifically, the lower gap 5 is set at such the dimension δ1 as to keep a part protruding upward, i.e., a ball part FB, at a base of the toe FF of the person shown in FIG. 5 from entering the lower gap 5. Accomplishment in keeping the ball part FB at the base of the toe FF from entering the lower gap 5 inhibits the toe FF of the foot F even put on the lower plate member 31 from being bent at the ball part FB. This consequently leads to difficulty in the clambering over the balustrade 1.

Digital Human Engineering Research Center at National Institute of Advanced Industrial Science and Technology in Japan and others found out through their studies that a height A1 (i.e., "ball height") from a sole to the ball part FB of the foot F of the three to six-year-old child as shown in FIG. 5 is around 19 mm to 28 mm. Taking this into consideration, the dimension δ1 of the lower gap 5 is preferably less than 19 mm, and more preferably around 16 mm to keep the ball part FB from entering the lower gap 5.

Furthermore, the lower end 4*a* of the blocking member 4 locates closer to the balcony outside S2 than an end part 31*a* of the lower plate member 31 on the balcony inside S1 at a horizontal distance X1 (around 10 mm).

The plate member 3 is decorated in a wooden pattern or the like, and thus has design property higher than that of the blocking member 4 in a plain and dark color (such as black or dark brown). The plate member 3 can have much higher design property if it is made of aluminum member or other material in a color which is the same as or similar to the color of aluminum. As shown in FIGS. 3 and 4, the blocking member 4 locates closer to the balcony outside S2 than the end part 31*a* of the plate member 3 (specifically, locates on an inner side in the space between the plate members 3) to fall in the shade of the plate member 3, and thus is invisible from the balcony inside S2. In contrast, the end part 31*a* of the plate member 3 decorated in the wooden pattern or the like is relatively visible. This results in improving the design property of the balustrade 1.

The lower end 4*a* of the blocking member 4 is at a position to keep the foot F from being put on an end of the end part 31*a* of the lower plate member 31 on the balcony inside S1. Specifically, the horizontal distance X1 between the lower end 4*a* of the blocking member 4 and the end of the end part 31*a* on the balcony inside S1 is determined to keep the foot F from being put on the end. For instance, the horizontal distance X1 of around 10 mm (e.g., 5 to 15 mm) makes it difficult to put the toe FF on the end part 31*a* of the plate member 31 while making the end part 31*a* of the plate member 31 visible from the balcony inside S. The distance is therefore preferable to prevent the clambering by inhibiting the toe FF from being bent in the region between the lower end 4*a* of the blocking member 4 and the end of the end part 31*a* of the lower plate member 31 on the balcony inside S1.

In the balustrade 1 shown in FIG. 1, the blocking member 4 may be arranged in each space between all the adjacent plate members 3, or may not be arranged in one or more spaces between the corresponding plate members 3 only in a lower section of the balustrade 1 to ensure the sufficient ventilation. In this case, the blocking member 4 at the lowest position has a height Y1 (i.e., a height from the bottom surface of the balcony B) set in accordance with a Japanese Housing Quality Assurance Act. Specifically, the height Y1 may be determined to keep the foot from being put on the plate member 3 at a position of 300 mm or higher in the balustrade 1 having the height of 1100 mm.

Figure 6:
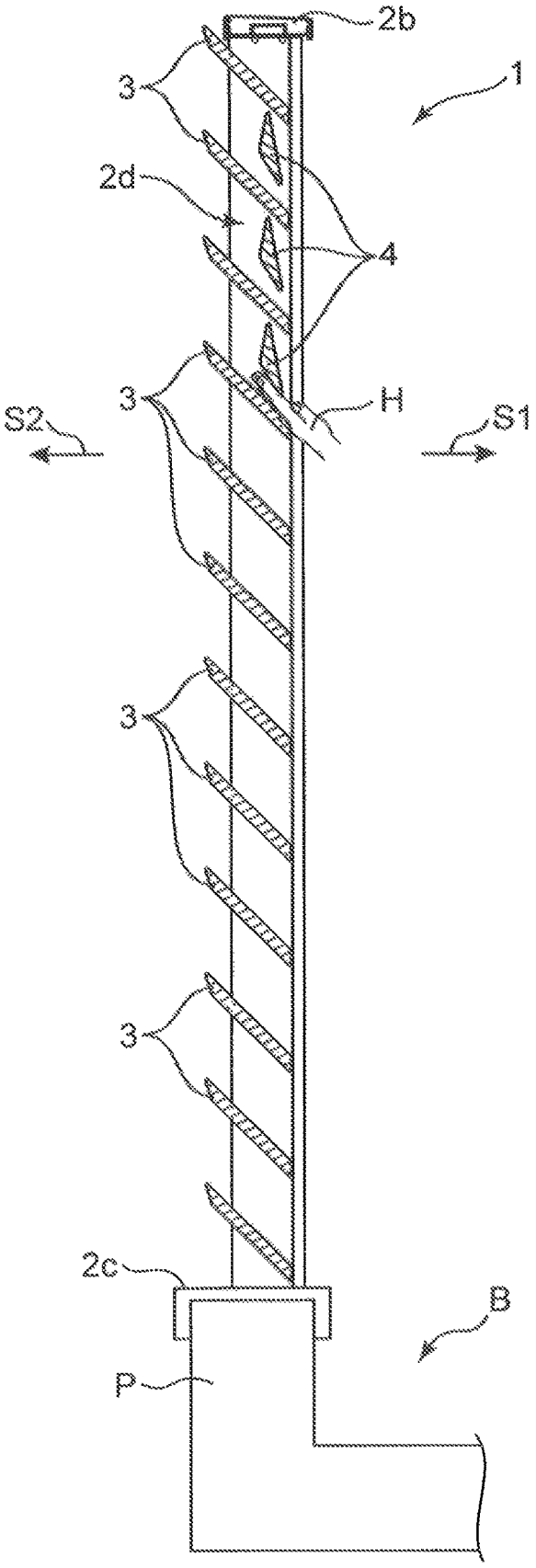
FIG. 6 is a longitudinal cross-sectional view showing a balcony balustrade installed at a balcony according to another embodiment of the present invention, the balcony balustrade being higher than that shown in FIG. 1.
Figure 7:
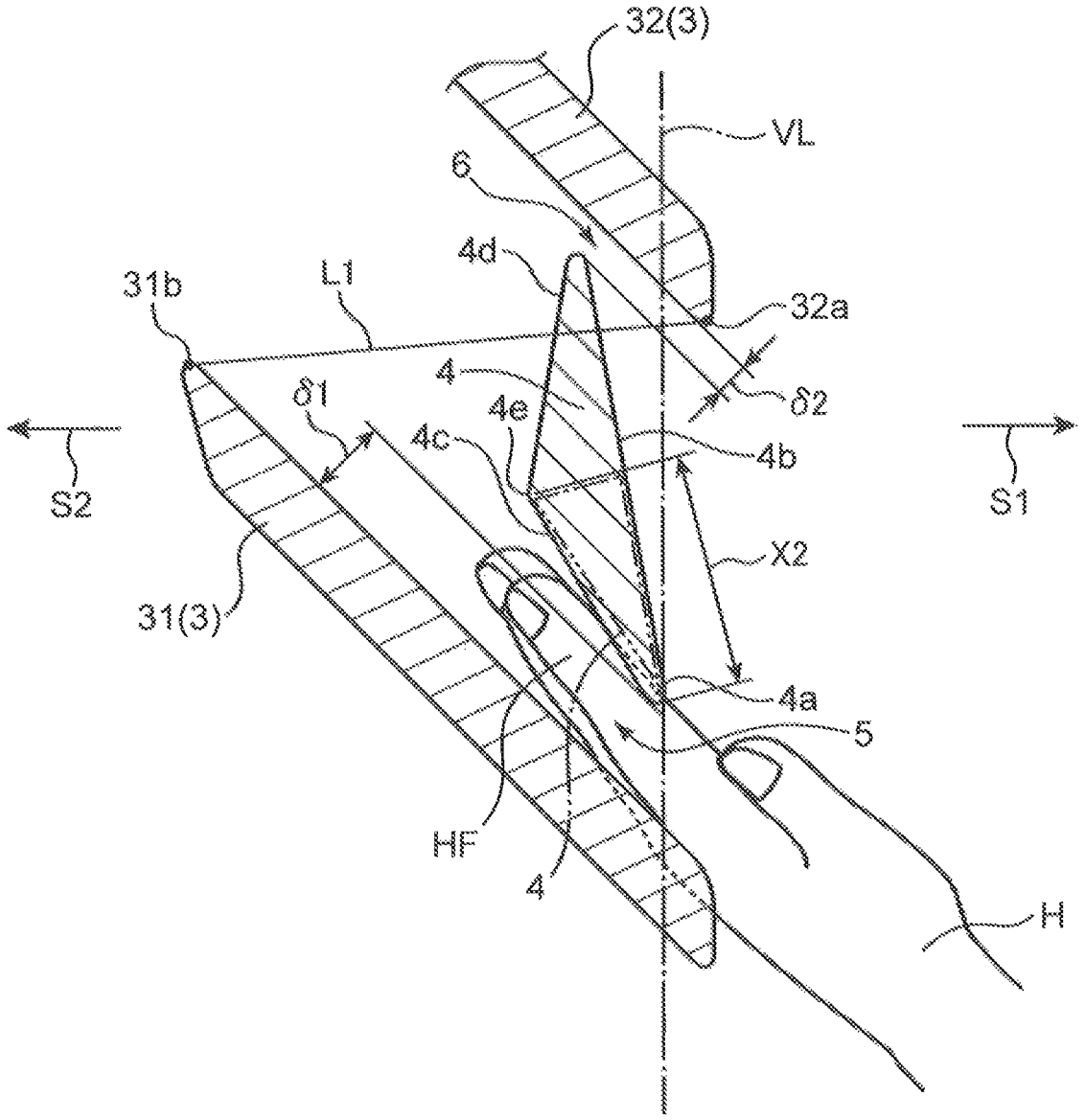
FIG. 7 is an enlarged cross-sectional view showing a state where a blocking member is arranged in a space between a pair of plate members shown in FIG. 6 for keeping a finger from holding the blocking member.

As shown in FIG. 6, another balustrade 1 according to another embodiment may be higher than the balustrade 1 shown in FIG. 1. In this case, a blocking member 4 may be at an appropriate location in an upper section of the balustrade 1 as shown in FIGS. 6 and 7. This arrangement makes it possible to keep the foot F from entering the space between the plate members 3, and further keep a hand H from entering the space between the plate members 3 to hold the blocking member 4 by the finger HF. Consequently, it is possible to effectively prevent the clambering over the balustrade 1 of both the high and low types.

More specifically, as shown in FIG. 7, the lower gap 5 between the lower end 4*a* of the blocking member 4 and the lower plate member 31 may be set at such the dimension δ1 as to keep the finger HF as well as the ball part FB of the foot F from entering the lower gap 5. In other words, the lower gap 5 having the dimension δ1 smaller than a thickness A2 at the base of the finger HF (specifically, a thickness A2 of the hand H at a knuckle HN at the base of the finger HF) of the person shown in FIG. 8 can keep the finger HF from entering the lower gap 5. Here, the thickness A2 of the hand H of the three to six-year-old child is 15 mm to 22 mm. Therefore, the dimension of less than 15 m is adaptable to keep the finger HF from entering the lower gap 5.

Figure 8:
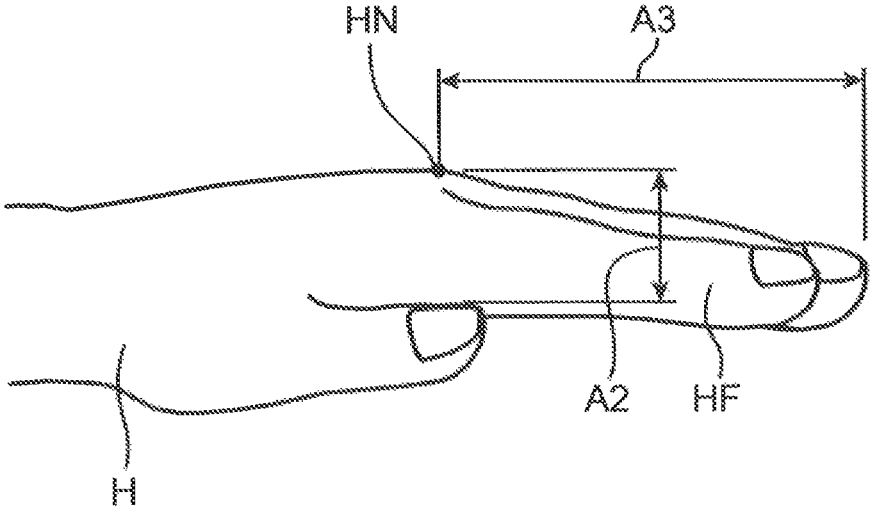
FIG. 8 is an explanatory view explaining a thickness of a hand, and a finger-tip-to-knuckle distance.

In this regard, Digital Human Engineering Research Center at National Institute of Advanced Industrial Science and Technology and others further revealed through their studies a correlation between the hand thickness A2 of the three-year-old child and the distance between the knuckle HN and the tip of the finger HF thereof, i.e., a finger-tip-to-knuckle distance A, shown in FIG. 8, specifically, a correlation between the hand thickness A2 of 15 mm and the finger-tip-to-knuckle distance A3 of around 48 mm. An inflection edge 4*e* (i.e., a corner) may be set at such a position between the second surface 4*c* and the third surface 4*d* as to keep the finger HF of the three-year-old child having the length (i.e., the finger-tip-to-knuckle distance A3) of 48 mm from holding the inflection edge 4*e*. Here, a distance X2 between the inflection edge 4*e* and the lower end 4*a* of the blocking member 4 is defined to be longer than 48 mm (e.g., 50 mm) to eliminate the possibility that the finger HF of the three-year-old child even inserted through the lower gap 5 having the dimension δ1 of 15 mm holds the inflection edge 4*e*.

Digital Human Engineering Research Center at National Institute of Advanced Industrial Science and Technology and others also ascertained through their studies another correlation between the hand thickness A2 of 16 mm and the finger-tip-to-knuckle distance A3 of around 56 mm concerning the three to six-year-old child. In a configuration where the dimension δ1 of the lower gap 5 is set at 16 mm, and the distance X2 between the inflection edge 4*e* and the lower end 4*a* of the blocking member 4 is set at 50 mm, the child having the hand thickness A2 of 16 mm fails to hold the inflection edge 4*e* by the finger HF even inserted through the lower gap 5 due to the finger-tip-to-knuckle distance A3 of only around 56 mm. This configuration also prevents the clambering by way of holding the blocking member 4 by the finger HF.

From all the aspects described above, the lower gap 5 having the dimension δ1 of around 16 mm or smaller (e.g., 16 mm) can prevent the three to six-year-old child from clambering over the balustrade by inserting the hand H, as well as the foot F, into the space between the plate members 3 to hold the blocking member 4 by the finger HF. As a result, it is possible to provide the advantageous effect of reliably preventing such high clambering.

As shown in FIG. 7, the blocking member 4 in the embodiment is arranged to define an upper gap 6 against the upper plate member 32. The upper gap 6 has such a dimension δ2 as to keep the finger HF of the person from entering the upper gap 6 to a length that allows the person to clamber over the balustrade 1. For example, the dimension δ2 of the upper gap 6 is preferably set at less than 15 mm, e.g., around 7 mm, in consideration that the thickness A2 of the hand H of the three to six-year-old child is 15 mm to 22 mm.

FEATURES OF EMBODIMENTS (1)

As described above, in the balustrade 1 according to the embodiment shown in FIG. 4, the lower end 4*a* of the blocking member 4 to prevent the clambering over the balustrade 1 is spaced upward from the lower plate member 31, and arranged to define the lower gap 5 against an upper surface of the lower plate member 31, the lower gap 5 having such the dimension δ1 as to keep the tip (specifically, the toe FF) of the foot of the person from entering the lower gap 5. This configuration accomplishes satisfactorily sufficient ventilation compared with a conventional configuration where a blocking member 4 closes a space between a pair of plate members 3, and further can prevent a person from clambering over the balustrade 1 by putting the foot F on the plate member 3.

Furthermore, as shown in FIGS. 3 and 4, the lower end 4*a* of the blocking member 4 locating closer to the balcony outside S2 than the end part 31*a* of the lower plate member 31 on the balcony inside S1 at the horizontal distance X1 can contribute to improvement in the design property by making the end part 31*a* of the plate member 3 on the balcony inside S1 relatively attractive while unnoticeably hiding the blocking member 4 on the inner side in the space between the plate members 3.

As a result, it is possible to prevent the person from clambering over the balcony balustrade 1 while ensuring the sufficient ventilation and high design property of the balustrade 1.

The balcony balustrade 1 according to the embodiment is excellent in all the perspectives of safety, design property, and ventilation performance.

Specifically, from the perspective of safety, the balustrade 1 according to the embodiment is designed to include the plate member 3 inclining at 45°, and the blocking member 4 having the diligently determined shape in accordance with a size of a specific portion of a body of a child so as to keep the foot and the finger from being put on the blocking member 4 to prevent the child from clambering over the balustrade 1. The balustrade thus has such a configuration as to prevent the clambering while ensuring a larger gap and higher design property than those of a conventional balustrade.

From the perspective of the design property, the balustrade 1 according to the embodiment is designed to include the posts 2*a* less visible from the outside (i.e., the balcony outside S2) and the coping 2*b* at a lowest position to emphasize a horizontal pattern formed by the plurality of plate members 3 extending in the horizontal direction. Besides, the blocking member 4 at a specific position has such a shape as to be invisible from the outside. Furthermore, the blocking member 4 is set back from the plate member 3 at a distance of around 10 mm (see the horizontal distance X1 shown in FIG. 4) and inclines at around 10° (see the inclination angle θ2 of the first surface 4*b* in FIG. 4) so that the horizontal pattern is perceivable from the inside (i.e., the balcony inside S1) as well.

Additionally, from the perspective of ventilation performance, the balustrade 1 according to each of the embodiments is designed to reduce the number of locations of blocking members 4 to the minimum while preventing the clambering in consideration of different heights of the balustrades 1 as shown in FIGS. 1 and 6, thereby ensuring sufficient ventilation. Particularly, it is determined from a clambering test that a way of keeping the hand from holding the blocking member 4 works more effectively than a way of keeping the foot from being put on the blocking member 4 for the balustrade 1 of the high type (e.g., having the height of around 1800 mm as a whole) as shown in FIG. 6. Under the determination, the number of locations of the blocking members 4 is reduced by arranging the blocking members 4 in the upper section of the balustrade 1 to prevent the clambering thereover.

Moreover, the gap (i.e., each of the lower gap 5 and the upper gap 6) between the plate member 3 and the blocking member 4 is determined to be maximum to ensure the sufficient ventilation from the balcony outside S2 to the balcony inside S1.

The balcony balustrade 1 according to the embodiment has the design property exhibiting luxury, and thus is available as an accent at a facade of a building such as a house.

The balcony balustrade 1 according to the embodiment can block a sight line from the balcony outside S2 while ensuring the sufficient ventilation and sunlight, and hence can produce a relaxing space or a service balcony where the privacy is reliably protected.

As described above, the balcony balustrade 1 according to the embodiment can produce a space giving attention to safety while ensuring the high design property and sufficient ventilation.

The balcony balustrade 1 according to the embodiment comprehensively provides the following advantageous effects.

The balcony balustrade 1 according to the embodiment includes the plate members 3 each having the wooden pattern and thus forming a horizontal wooden pattern in the balustrade. Consequently, novel design property in appearance is obtainable.

The balcony balustrade 1 according to the embodiment can produce a bright and opened balcony space while reliably protecting the privacy.

In the balcony balustrade 1 according to the embodiment, it possible to increase the dimension of the gap (i.e., each of the lower gap 5 and the upper gap 6) while giving attention to the safety by reconsidering the body size of a child in combination with the inclination of the plate member 3.

The blocking member 4 is commonly adaptable to balcony balustrades 1 having different heights such as those shown in FIGS. 1 and 6 to prevent the clambering over the balustrades, thereby achieving cost reduction.

(2)

In the balcony balustrade 1 according to the embodiment, the plate members 3 incline downward from the balcony outside S2 to the balcony inside S1 as shown in FIGS. 3 and 4. Hence, the balcony balustrade 1 can provide a sight line blocking effect owing to obstruction of the plate members 3 even when an attempt is made to see the balcony inside S1 from the balcony outside S2. Moreover, the plate members 3 incline to be lower on the balcony inside S1 than the balcony outside S2. Therefore, an attempt to put the foot F on the plate member 3 from the balcony outside S2 fails since the foot F is likely to be slipped off from the plate member 3. Consequently, the effect of preventing the clambering over the balustrade 1 is further increased.

From the perspective of the design property, in a case that the plate members 3 incline downward from the balcony outside S2 to the balcony inside S1 at the angle θ1 of 45° as shown in FIG. 4, the blocking member 4 becomes invisible from the balcony outside S2 under the condition that the balustrade satisfies a predetermined height at a predetermined distance. For example, it has been confirmed by the present inventors through their experiments that the balcony balustrade 1 installed at the height of 4 m from the ground prevents a person (having a standard eye height of 1.6 m) looking up from a lower position in the direction of the blocking member 4 of the balustrade 1 at a horizontal distance of 6 m or longer from the balustrade 1 to the outside S2 from seeing the blocking member 4 hidden between the plate members 3 due to an elevation angle of 22° or smaller to the upper end of the plate member 3 (i.e., an inclination angle of the sight line to the horizontal plane).

(3)

In the balcony balustrade 1 according to the embodiment, the lower end 4*a* of the blocking member 4 is at a position to keep the foot F from being put on the end of the end part 31*a* of the lower plate member 31 on the balcony inside S1, that is, at a position closer to the end part 31*a* on the balcony inside S1 to keep the foot F from being put on the end. In this arrangement, the person fails to put the foot F on the end part 31*a* of the plate member 3 on the balcony inside S1 owing to the blocking by the lower end 4*a* of the blocking member 4. Consequently, it is possible to reliably prevent the person from clambering over the balustrade 1.

(4)

In the balustrade 1 according to the embodiment, the lower gap 5 is set at such the dimension δ1 as to keep the ball part FB at the base of the toe FF of the person from entering the lower gap 5. This configuration keeps the ball part FB at the base of the toe FF of the person from entering the lower gap 5. Thus, the toe FF of the foot F even put on the lower plate member 31 cannot be bent at the ball part FB. Consequently, it is possible to further reliably prevent the person from clambering over the balustrade 1.

(5)

In the balcony balustrade 1 according to the embodiment, the blocking member 4 has the first surface 4*b* facing the balcony inside S1, the first surface 4*b* intersecting the vertical plane VL at the angle smaller than the angle between the plate member 3 and the vertical plane VL. This configuration makes it difficult to put the foot F on the first surface 4*b*, and hence can further reliably prevent the person from clambering over the balustrade 1.

(6)

In the balcony balustrade 1 according to the embodiment, the blocking member 4 has the second surface 4*c* facing the balcony outside S2, the second surface 4*c* inclining toward the balcony outside S2 as advancing upward from the lower end 4*a* of the blocking member 4. Thus, as shown in FIGS. 6 and 7, the blocking member 4 keeps the finger HF even inserted through the lower gap 5 between the blocking member 4 and the lower plate member 31 from holding the second surface 4*c* of the blocking member 4. This configuration consequently can further reliably prevent the person from clambering over the balustrade 1.

(7)

Specifically, in the balcony balustrade 1 according to the embodiment, in a view in the direction in which the plate member 3 extends (i.e., in a view in the perpendicular direction on the paper in FIG. 4), the blocking member 4 has the first surface 4*b* serving as a foot-putting preventive surface facing the balcony inside S1 and extending upward from the lower end 4*a* of the blocking member 4 so as to keep the foot F from being put on the blocking member 4, and the second surface 4*c* serving as a holding preventive surface extending from the lower end 4*a* of the blocking member 4 toward the balcony outside S2 so as to keep the person from holding the blocking member 4 by the finger HF (see FIG. 7) inserted through the lower gap 5 from the balcony inside S1.

This configuration which includes the blocking member 4 having the first surface 4*b* serving as the foot-putting preventive surface and the second surface 4*c* serving as the holding preventive surface attains two preventions. Specifically, the first surface 4*b* serving as the foot-putting preventive surface faces the balcony inside S1 and extends upward from the lower end of the blocking member so as to keep the foot F from being put on the blocking member 4. Besides, the second surface 4*c* serving as the holding preventive surface extends from the lower end 4*a* of the blocking member 4 toward the balcony outside S2 so as to keep the person from holding the blocking member 4 by the finger HF inserted through the lower gap 5 from the inside.

(8)

In the balcony balustrade 1 according to the embodiment, the blocking member 4 has the third surface 4*d* facing the balcony outside S2, the third surface 4*d* extending toward the balcony inside S1 as advancing upward from an upper end of the second surface 4*c*. As shown in FIG. 7, the inflection edge 4*e* between the second surface 4*c* and the third surface 4*d* is spaced away from the lower end 4*a* of the blocking member 4 toward the balcony outside S2 to ensure such a distance as to keep the finger HF of the person inserted through the lower gap 5 from holding the inflection edge 4*e*. In this configuration, even the finger HF inserted through the lower gap 5 cannot hold the inflection edge 4*e*. Accordingly, it is possible to further reliably prevent the person from clambering over the balustrade 1.

(9)

In the balcony balustrade 1 according to the embodiment, the blocking member 4 is arranged to define the upper gap 6 against the upper plate member 32 as shown in FIG. 7. The upper gap 6 has such the dimension δ2 as to keep the finger HF of the person from entering the upper gap 6 to a length that allows the person to clamber over the balustrade 1. This configuration where the finger HF is kept from entering the upper gap 6 can further reliably prevent the person from clambering over the balustrade 1.

(10)

The balcony balustrade 1 according to the embodiment is designed by presuming the "person" to be a three to six-year-old child who is highly likely to clamber over the balustrade 1 and fall down from the balcony B.

Specifically, the balustrade 1 is designed in accordance with the size of the foot F, the hand H and the like of such a three to six-year-old child who is highly likely to fall down from the balcony B by clambering over the balustrade 1. In this manner, the balustrade 1 expected to avoid the falling-down of the child is obtainable.

(Supplemental Explanation Concerning Arrangement and Configuration of the Blocking Member in Each of the Embodiments)

Hereinafter, the arrangement and the configuration of the blocking member 4 in each of the embodiments will be described by using lower and upper offset planes OL1 and OL2 shown in FIG. 9 for full understanding of the technology of preventing a person from clambering over the balcony balustrade 1 according to the embodiment while ensuring sufficient ventilation thereof.

Specifically, the blocking member 4 shown in FIG. 9 lies between the lower offset plane OL1 extending above the lower plate member 31 at a spacing distance of the lower gap 5 in parallel with the upper surface of the lower plate member 31 and the upper offset plane OL2 extending below the upper plate member 32 at a spacing distance of the upper gap 6 in parallel with the lower surface of the upper plate member 32. The lower gap 5 has such the dimension δ1 as to keep the tip (specifically, the toe FF) of the foot of the person from entering the gap between the blocking member 4 and the upper surface of the lower plate member 31. Moreover, the upper gap 6 has such the dimension δ2 as to keep the finger HF of the person from entering the upper gap 6 between the upper plate member 32 and the blocking member 4 as in the embodiment.

Figure 9:
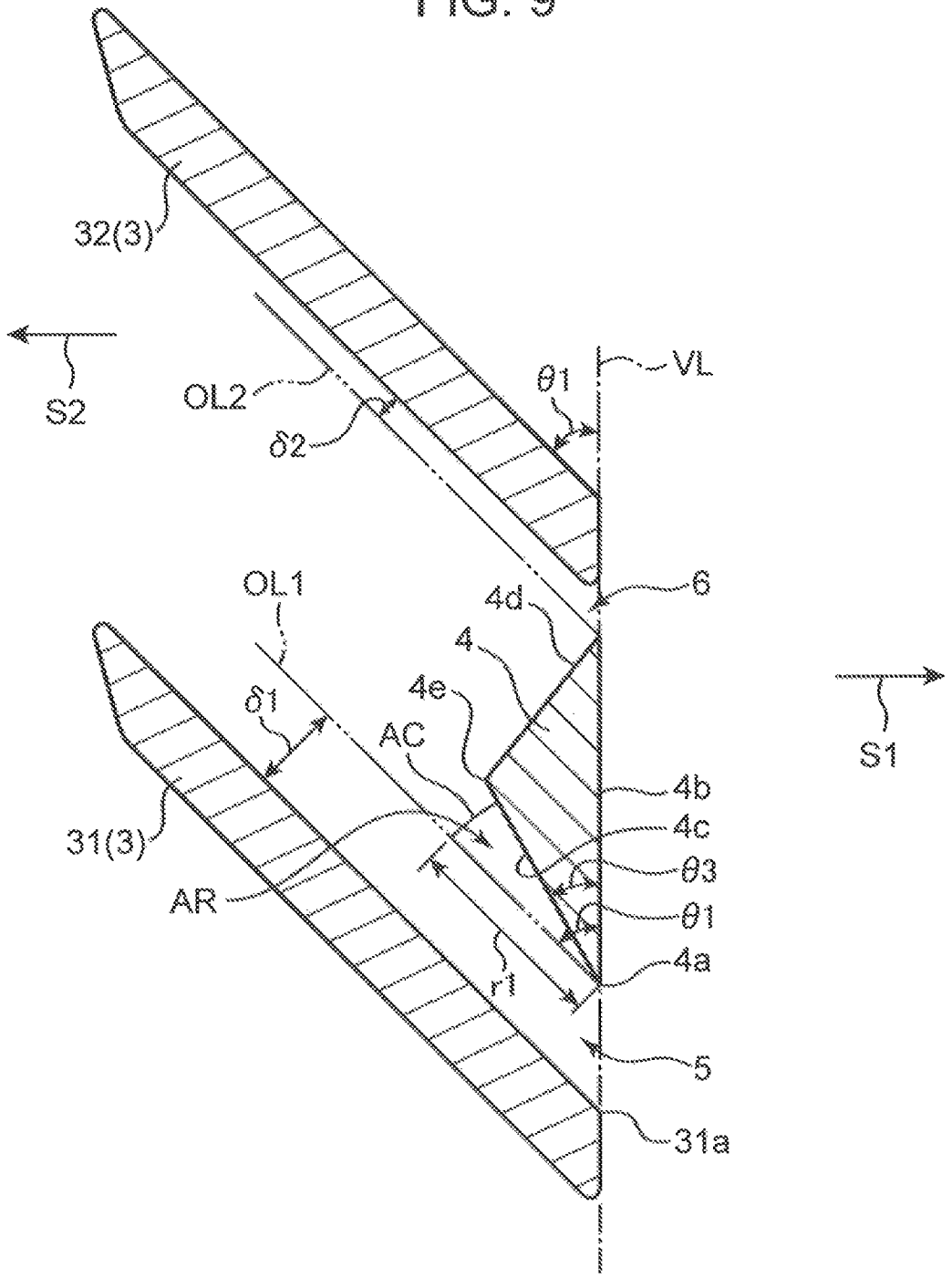
FIG. 9 is an explanatory view explaining an arrangement and a configuration of the blocking member in the balcony balustrade according to each of the embodiments of the present invention by using upper and lower offset planes.

This configuration shown in FIG. 9 can ensure the sufficient ventilation by defining the gaps 5, 6 respectively at both the higher and lower positions of the blocking member 4, and keep the tip of the foot from entering the lower gap 5 and the finger HF from entering the upper gap 6. In this way, it is possible to further reliably prevent the person from clambering over the balustrade 1 while ensuring the sufficient ventilation.

The lower gap 5 between the blocking member 4 and the lower plate member 31 with such the dimension δ1 as to allow the blocking member 4 to block the entering of the tip of the foot by at least a portion (e.g., at the entire portion or intermittent portions) of the blocking member 4 in the axial direction thereof (in a direction extending between the pair of posts 2*a*) can keep the tip of the foot from entering the lower gap 5. Similarly, the upper gap 6 between the blocking member 4 and the upper plate member 33 with such the dimension δ2 as to allow the blocking member 4 to block the entering of the finger at least a portion (e.g., at the entire portion or intermittent portions) of the blocking member 4 in the axial direction thereof can keep the finger from entering the upper gap 6.

The blocking member 4 shown in FIG. 9 has the first surface 4*b* facing the balcony inside S1. The first surface 4*b* extends from the lower end 4*a* of the blocking member 4 to reach the upper offset plane OL2. In this configuration, the first surface 4*b* of the blocking member 4 that faces the balcony inside S1 keeps the tip of the foot from entering the lower gap 5 by coming into contact with the tip of the foot, and further keeps the finger HF from entering the upper gap 6 by coming into contact with the hand.

The first surface 4*b* shown in FIG. 9 intersects the vertical plane VL at the angle (e.g., 0°) smaller than the angle (the angle θ1) between the plate member 3 (i.e., each of the lower and upper plate members 31, 32) and the vertical plane VL. This configuration makes it difficult to put the foot F on the first surface 4*b*, and hence can further reliably prevent the person from clambering over the balustrade 1.

The first surface 4*b* shown in FIG. 9 is just above the end part 31*a* of the lower plate member 31, that is, on the vertical plane VL. Accordingly, it is possible to reliably keep the foot from being put on the lower plate member 31.

Furthermore, the blocking member 4 shown in FIG. 9 has the second surface 4*c* facing the balcony outside S2, the second surface 4*c* inclining toward the balcony outside S2 as advancing upward from the lower end 4*a* of the blocking member 4. The second surface 4*c* intersects the vertical plane VL at the angle θ3 (e.g., 30° or more) smaller than the angle (the angle θ1) between the lower offset plane OL1 and the vertical plane VL to keep the finger from holding the second surface 4*c*. In this configuration, the blocking member 4 has the second surface 4*c* facing the balcony outside S2, the second surface 4*c* inclining toward the balcony outside S2 as advancing upward from the lower end 4*a* of the blocking member 4. As aforementioned, the second surface 4*c* intersects the vertical plane VL at the angle θ3 smaller than the angle (the angle θ1) between the lower offset plane OL1 and the vertical plane VL to keep the finger from holding the second surface 4*c*. Therefore, the lower gap 5 opens more widely toward the balcony outside S2 to thereby keep the finger HF even inserted through the lower gap 5 between the blocking member 4 and the lower plate member 31 from holding the second surface 4*c* of the blocking member 4 while increasing the ventilation from the balcony outside S2 to the balcony inside S1. As a result, it is possible to further reliably prevent the person from clambering over the balustrade 1 while improving the ventilation. The angle θ3 between the second surface 4*c* and the vertical plane VL to keep the finger HF from holding the second surface 4*c* is preferably, for example, 30° or more, and more preferably is in the range of 30° to 45°.

The blocking member 4 shown in FIG. 9 has the third surface 4*d* facing one side, the third surface 4*d* extending toward the other side as advancing upward from an upper end of the second surface 4*c*. The inflection edge 4*e* between the second surface 4*c* and the third surface 4*d* is on or outside (above) a boundary of a region AR defined by the second surface 4*c*, a locus arc AC, and the lower offset plane OL1. The locus arc AC is drawn at a position where a tip of the finger HF of the person inserted through the lower gap 5 from the lower end 4*a* of the blocking member 4 fails to hold the locus arc AC. Here, the locus arc AC has a radius r1 as a distance from the lower end 4*a* of the blocking member 4 serving as the center to keep the finger HF of the person inserted through the lower gap 5 from the lower end 4*a* from holding the locus arc AC.

The radius r1 is preferably at a distance longer than 48 mm (e.g., 50 mm) like the distance X2. This configuration eliminates the possibility that the three-year-old child holds the inflection edge 4*e* by the finger HF even inserted through the lower gap 5 having the dimension of 15 mm.

In this configuration, the inflection edge 4*e* between the second surface 4*c* and the third surface 4*d* is at such a specific position as to keep the finger HF (specifically, the first knuckle of the middle finger) of the person inserted through the lower gap 5 from holding the inflection edge 4*e*. Accordingly, this configuration where even the finger HF inserted through the lower gap 5 fails to hold the inflection edge 4*e* can further reliably prevent the person from clambering over the balustrade.

Meanwhile, even in a case that the second surface 4*c* has a protrusion, the finger HF is kept from holding the protrusion under the condition that the protrusion is on or outside (above) the boundary of the region AR.

Figure 10:
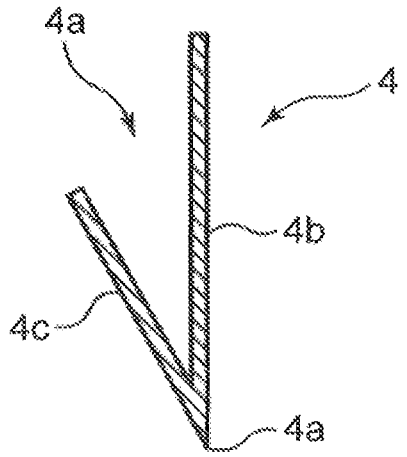
FIG. 10 is an explanatory cross-sectional view showing a modified blocking member in a V-like cross-sectional shape having only a first surface and a second surface corresponding to those shown in FIG. 9.
Figure 11A:
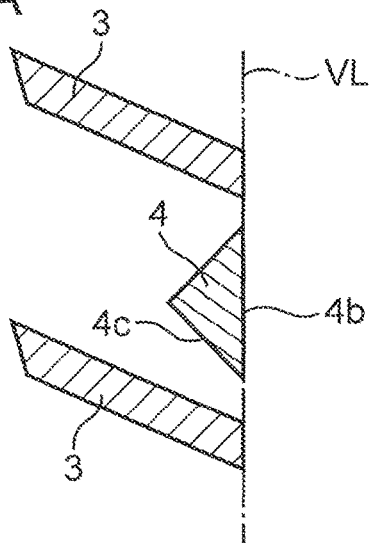
FIGS. 11(*a*) to 11(*h*) show different cross-sectional shapes of various exemplary modified blocking members of the present invention.
Figure 11B:
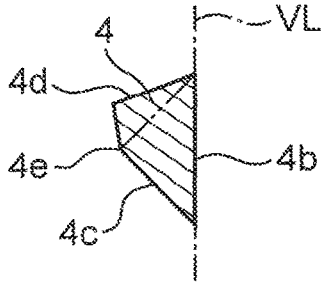
Figure 11C:
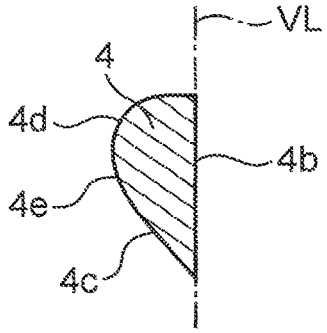
Figure 11D:
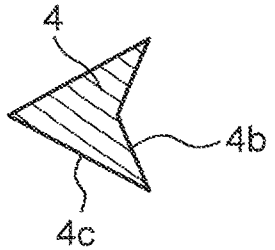
Figure 11E:
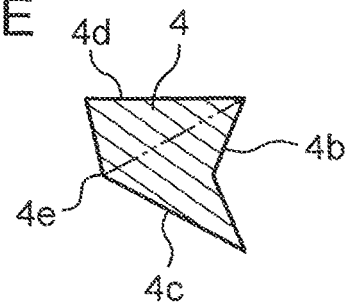
Figure 11F:
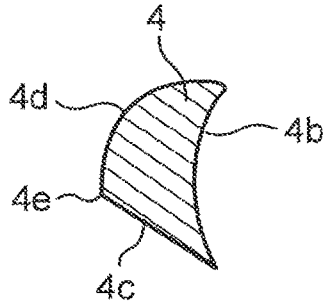
Figure 11G:
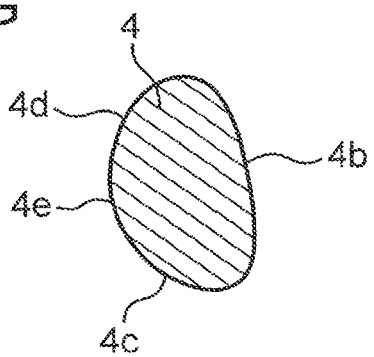
Figure 11H:
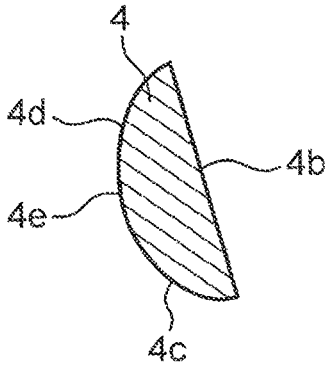

The blocking member 9 shown in FIG. 9 has the first surface 4*b*, the second surface 4*c*, and the third surface 4*d* defining a triangular cross-sectional shape, but should not be limited thereto. Instead, the blocking member 4 may have only the first surface 4*b* and the second surface 4*c* defining a V-like cross-sectional shape such as a modified blocking member of the present invention shown in FIG. 10. Even in this case, the first surface 4*b* can block the insertion through both the lower and upper gaps 5, 6, and the second surface 4*c* can keep the finger HF from holding the blocking member 4.

Modifications (A)

The blocking member 4 in the embodiment has the cross-sectional shape, i.e., the triangular cross-sectional shape, shown in FIG. 4, and further has the first surface 4*b* facing the balcony inside S1 and inclining toward the balcony outside S2 at the inclination angle θ2 to the vertical plane VL. However, the present invention should not be limited thereto. The blocking member 4 can have any other desired cross-sectional shape in the present invention.

For instance, the angle θ2 between the first surface 4*b* and the vertical plane VL can be set within the range of 0° to 45°. Hence, like a modified blocking member 4 of the present invention shown in FIG. 11(*a*), the angle θ2 between the first surface 4*b* and the vertical plane VL may be set at 0° (specifically, the first surface 4*b* may stand upright). The blocking member 4 shown in FIG. 11(*a*) has a first surface 4*b* serving as the foot-putting preventive surface, and a second surface 4*c* serving as the holding preventive surface like the above-described feature (7) (in the embodiment), and therefore attains two preventions of foot-putting prevention and holding prevention.

The blocking member 4 shown in FIG. 11(*a*) having the cross-sectional shape shown in FIG. 11(*a*) may be further modified to have a quadrangular cross-sectional shape shown in FIG. 11(*b*), and a substantially sector cross-sectional shape shown in FIG. 11(*c*). In the blocking member 4 shown in each of FIGS. 11(*b*) and 11(*c*), a third surface 4*d* extending from an upper end (at an inflection edge 4*e*) of a second surface 4*c* is bent or curved. However, a first surface 4*b* serves as the foot-putting preventive surface, and a second surface 4*c* serves as the holding preventive surface like those in FIG. 11(*a*), and thus they contribute to the two preventions of foot-putting prevention and holding prevention.

Various modified blocking members 4 of the present invention as shown in FIGS. 11(*d*) and 11(*e*) where a first surface 4*b* is recessed and has a polygonal cross-sectional shape may be adopted. In FIG. 11(*e*), the third surface 4*d* is bent. Even the recessed first surface 4*b* of the blocking member 4 shown in each of FIGS. 11(*d*) and 11(*e*) extends upward at an angle closer to the vertical plane than the plate member 3 (see FIG. 4), and hence exerts the foot-putting prevention. Further, the second surface 4*c* can exert the holding prevention.

Additionally, as shown in FIG. 11(*f*), another modified blocking member 4 of the present invention may have a concaved first surface 4*b*, and a convex third surface 4*d*. In this case, the concaved first surface 4*b* extends upward at the angle closer to the vertical plane than the plate member 3 (see FIG. 4), and hence exerts the foot-putting prevention. Further, a second surface 4*c* can exert the holding prevention.

As shown in FIG. 11(*g*), further another modified blocking member 4 of the present invention may have a substantially oval cross-sectional shape where a first surface 4*b*, a second surface 4*c*, and a third surface 4*d* curvedly bulge outward. The first surface 41*b* even bulging outward extends upward at the angle closer to the vertical plane than the plate member 3 (see FIG. 4), and hence exerts the foot-putting prevention. Besides, the second surface 4*c* bulging outward keeps the finger from holding the second surface 4*c*, and thus can exert the holding prevention.

As shown in FIG. 11(*h*), still another modified blocking member 4 of the present invention may have a first surface 4*b* which is solely plane, and a second surface 4*c* and a third surface 4*d* each curvedly bulging outward. Even in this case, the first surface 4*b* serves as the foot-putting preventive surface, and the second surface 4*c* serves as the holding preventive surface, and thus they contribute to two preventions of foot-putting prevention and holding prevention. Further, in FIG. 11(*h*), the second surface 4*c* bulging outward keeps the finger from holding the second surface 4*c*, and thus can exert the holding prevention.

(B)

The blocking member 4 shown in FIG. 4 may lie below a line L1 (see FIG. 7) connecting a lower end 32*a* of the upper plate member 32 on the balcony inside S1 and an upper end 31*b* of the lower plate member 31 on the balcony outside S2 with each other (e.g., see the blocking member 4 having the triangular cross-sectional shape denoted by a long dashed double-short dashed line). In this case, the blocking member 4 becomes invisible even when the horizontal distance from the balustrade 1 is shorter than 6 m.

(C)

In the embodiment, the blocking member 4 is made of a long solid member having the triangular cross-sectional shape and the like. However, the present invention should not be limited thereto. The blocking member 4 may have a ventilating configuration, for example, a hollow cylindrical body made of grating or net. Adoption of the hollow blocking member 4 having this configuration makes it possible to prevent the clambering of the person while ensuring the sufficient ventilation by narrowing the space between the pair of plate members.

(D)

In the embodiment, the balcony balustrade is described as an exemplary fence according to the present invention. However, the present invention should not be limited thereto. The fence according to the present invention may be any fence installed in a standing state for partitioning a predetermined place into an area on inside and an area on outside. Hence, the fence according to the present invention includes a balustrade surrounding a periphery of a balcony or a veranda similar thereto of a building, a fence surrounding the ground at a predetermined place such as a garden around a building, a park, a playground, and the like. Adoption of the technology of the present invention in a balustrade or fence of this type makes it possible to prevent the person from clambering over the balustrade or fence while ensuring the sufficient ventilation and high design property thereof.

The sheet described in connection with each of the embodiments mainly includes the following features.

A fence according to the embodiment is installed in a standing state for partitioning a predetermined place into an area on inside and an area on outside, the fence including: a plurality of posts; a pair of plate members extending between the plurality of posts in a horizontal direction and fixedly attached to the plurality of posts, the pair of plate members being spaced away from each other in a vertical direction; and a blocking member arranged in the space between the plate members for keeping a foot of a person from entering the space between the plate members to prevent the person from clambering over the fence, wherein a lower end of the blocking member is spaced upward from the plate member at a lower position, and defines a lower gap against an upper surface of the plate member at the lower position, the lower gap having such a dimension as to keep a tip of the foot of the person from entering the lower gap.

In this configuration, the lower end of the blocking member is spaced upward from the lower plate member, and is arranged to define the lower gap against the upper surface of the lower plate, the lower gap having such a dimension as to keep the tip of the foot of the person from entering the lower gap. This configuration accomplishes satisfactorily sufficient ventilation compared with a conventional configuration where a blocking member closes a space between a pair of plate members, and further can prevent a person from putting the foot on the plate member to thereby clamber over the fence.

Here, the "predetermined place" in the present invention means a specific place to be portioned into an area on inside and an area on outside, and includes a garden around a building, a park, a playground and the like as well as a balcony or a veranda similar thereto of a building.

In the fence, the plate members preferably incline downward from the outside to the inside.

In this configuration, the plate members incline downward from the outside to the inside of the predetermined place. Hence, the fence can provide a sight line blocking effect owing to the obstruction of the plate members even when an attempt is made to see the inside from the outside. Moreover, the plate members incline to be lower on the inside than the outside. Therefore, even an attempt to put the foot on the plate member from the inside fails since the foot is likely to be slipped off from the plate member. Consequently, the effect of preventing the clambering over the fence is further increased.

In the fence, the lower end of the blocking member is preferably at a position to keep the foot from being put on an inside end of the plate member at the lower position.

In this configuration, the lower end of the blocking member is at a position to keep the foot from being put on the inside end of the inside end part of the lower plate member, that is, at a position closer to the inside end part to keep the foot from being put thereon. In this arrangement, the person is kept from putting the foot on the inside end part of the plate member owing to the blocking by the lower end of the blocking member. Consequently, it is possible to reliably prevent the person from clambering over the fence.

In the fence, the lower gap is preferably set at such a dimension as to keep a ball pat at a base of a toe of the person from entering the lower gap.

In this configuration, the ball part at the base of the toe of the person is kept from entering the lower gap. Thus, the toe of the foot even put on the lower plate member cannot be bent at the ball part. Consequently, it is possible to further reliably prevent the person from clambering over the fence.

In the fence, the blocking member preferably has a first surface facing the inside, the first surface intersecting a vertical plane at an angle smaller than an angle between the plate member and the vertical plane.

In this configuration, the blocking member has the first surface facing the inside, the first surface intersecting the vertical plane at the angle smaller than the angle between the plate member and the vertical plane. This configuration makes it difficult to put the foot on the first surface, and hence can further reliably prevent the person from clambering over the fence.

In the fence, the blocking member preferably has a second surface facing the outside, the second surface inclining toward the outside as advancing upward from the lower end of the blocking member.

In this configuration, the blocking member has the second surface facing the outside, the second surface inclining toward the outside as advancing upward from the lower end of the blocking member. Thus, the blocking member keeps the finger even inserted through the lower gap between the blocking member and the lower plate member from holding the second surface of the blocking member. This configuration consequently can further reliably prevent the person from clambering over the fence.

In a view in the direction in which the plate members extend in the fence, the blocking member preferably has a foot-putting preventive surface facing the inside and extending upward from the lower end of the blocking member so as to keep the foot from being put on the blocking member, and a holding preventive surface extending from the lower end of the blocking member toward the outside so as to keep the person from holding the blocking member by a finger inserted through the lower gap from the inside.

This configuration which includes the blocking member having the foot-putting preventive surface and the holding preventive surface attains two preventions. Specifically, the foot-putting preventive surface faces the inside and extends upward from the lower end of the blocking member so as to keep the foot from being put on the blocking member. Besides, the holding preventive surface extends from the lower end of the blocking member to the outside so as to keep the person from holding the blocking member by the finger inserted through the lower gap from the inside.

In the fence, the blocking member preferably defines an upper gap against the plate member at a higher position, the upper gap having such a dimension as to keep a finger of the person from entering the upper gap to a length that allows the person to clamber over the fence.

In this configuration, the upper gap has such the dimension as to keep the finger of the person from entering the upper gap to a length that allows the person to clamber over the fence. This configuration where the finger is kept from entering the upper gap can further reliably prevent the person from clambering over the fence.

In the fence, the lower end of the blocking member preferably locates closer to the outside than an inside end part of the plate member at the lower position.

In this configuration, the lower end of the blocking member locating closer to the outside than the inside end part of the lower plate member can contribute to improvement in the design property by making the inside end part of the plate member relatively attractive while unnoticeably hiding the blocking member on the inner side in the space between the plate members. As a result, it is possible to prevent the person from clambering over the fence while ensuring the sufficient ventilation and high design property of the fence.

In the fence, the blocking member may lie between a lower offset plane extending above the plate member at the lower position at a spacing distance of the lower gap and an upper offset plane extending below the plate member at the higher position at a spacing distance of an upper gap, the upper gap having such a dimension as to keep a finger of the person from entering the gap between the blocking member and the plate member at the higher position.

This configuration can ensure the sufficient ventilation by defining the gaps respectively at both the higher and lower positions of the blocking member, and keep the tip of the foot from entering the lower gap and the finger from entering the upper gap. In this way, it is possible to further reliably prevent the person from the clambering over the fence while ensuring the sufficient ventilation.

In the fence, the blocking member may have a first surface facing the inside, the first surface extending from the lower end of the blocking member to reach the upper offset plane.

In this configuration, the first surface of the blocking member that faces the inside keeps the tip of the foot from entering the lower gap by coming into contact with the tip of the foot, and further keeps the finger from entering the upper gap by coming into contact with the hand.

In the fence, the blocking member may have a second surface facing the outside, the second surface inclining toward the outside as advancing upward from the lower end of the blocking member, and intersecting a vertical plane at an angle smaller than an angle between the lower offset plane and the vertical plane to keep the finger from holding the second surface.

In this configuration, the blocking member has the second surface facing the outside, the second surface inclining toward the outside as advancing upward from the lower end of the blocking member. The second surface intersects the vertical plane at the angle smaller than the angle between the lower offset plane and the vertical plane to keep the finger from holding the second surface. Therefore, the lower gap opens more widely toward the outside to thereby keep the finger even inserted through the lower gap between the blocking member and the lower plate member from holding the second surface of the blocking member while increasing the ventilation from the outside to the inside. As a result, it is possible to further reliably prevent the person from clambering over the fence while improving the ventilation.

In the fence, the blocking member may have a third surface facing one side, the third surface extending toward the other side as advancing upward from an upper end of the second surface, an inflection edge between the second surface and the third surface being on or outside a boundary of a region defined by the second surface, a locus arc, and the lower offset plane, the locus arc being drawn at a position where a tip of the finger of the person inserted through the lower gap from the lower end of the blocking member fails to hold the locus arc.

In this configuration, the inflection edge between the second surface and the third surface is at such a specific a position as to keep the finger of the person inserted through the lower gap from holding the inflection edge. Accordingly, it is possible to further reliably prevent the person from clambering over the fence.

The fence preferably has a configuration suitable for a specific person, that is, a three to six-year-old child.

The fence is designed in accordance with a size of a foot, a hand and the like of such a three to six-year-old child who is highly likely to fall down from the balcony by clambering over the fence. In this manner, the fence expected to avoid the falling-down of the child is obtainable.

The fence in the embodiment can prevent a person from clambering over the fence while ensuring sufficient ventilation.

The invention claimed is:

1. A fence installed in a standing state for partitioning a predetermined place into an area on inside and an area on outside, the fence comprising:

a plurality of posts;

a pair of plate members extending between the plurality of posts in a horizontal direction and fixedly attached to the plurality of posts, the pair of plate members being spaced away from each other in a vertical direction; and a blocking member arranged in the space between the plate members for keeping a foot of a person from entering the space between the plate members to prevent the person from clambering over the fence, wherein a lower end of the blocking member is spaced upward from the plate member at a lower position, and defines a lower gap against an upper surface of the plate member at the lower position, the lower gap having such a dimension as to keep a tip of the foot of the person from entering the lower gap.

2. The fence according to claim 1, wherein the plate members incline downward from the outside to the inside.

3. The fence according to claim 1, wherein the lower end of the blocking member is at a position to keep the foot from being put on an inside end of the plate member at the lower position.

4. The fence according to claim 1, wherein the lower gap is set at such a dimension as to keep a ball part at a base of a toe of the person from entering the lower gap.

5. The fence according to claim 1, wherein the blocking member has a first surface facing the inside, the first surface intersecting a vertical plane at an angle smaller than an angle between the plate member and the vertical plane.

6. The fence according to claim 1, wherein the blocking member has a second surface facing the outside, the second surface inclining toward the outside as advancing upward from the lower end of the blocking member.

7. The fence according to claim 1, wherein in a view in the direction in which the plate members extend, the blocking member has a foot-putting preventive surface facing the inside and extending upward from the lower end of the blocking member so as to keep the foot from being put on the blocking member, and a holding preventive surface extending from the lower end of the blocking member toward the outside so as to keep the person from holding the blocking member by a finger inserted through the lower gap from the inside.

8. The fence according to claim 1, wherein the blocking member defines an upper gap against the plate member at a higher position, the upper gap having such a dimension as to keep a finger of the person from entering the upper gap to a length that allows the person to clamber over the fence.

9. The fence according to claim 1, wherein the lower end of the blocking member locates closer to the outside than an inside end part of the plate member at the lower position.

10. The fence according to claim 1, wherein the blocking member lies between a lower offset plane extending above the plate member at the lower position at a spacing distance of the lower gap and an upper offset plane extending below the plate member at the higher position at a spacing distance of an upper gap, the upper gap having such a dimension as to keep a finger of the person from entering the gap between the blocking member and the plate member at the higher position.

11. The fence according to claim 10, wherein the blocking member has a first surface facing the inside, the first surface extending from the lower end of the blocking member to reach the upper offset plane.

12. The fence according to claim 11, wherein the blocking member has a second surface facing the outside, the second surface inclining toward the outside as advancing upward from the lower end of the blocking member, and intersecting a vertical plane at an angle smaller than an angle between the lower offset plane and the vertical plane to keep the finger from holding the second surface.

13. The fence according to claim 12, wherein the blocking member has a third surface facing one side, the third surface extending toward the other side as advancing upward from an upper end of the second surface, an inflection edge between the second surface and the third surface being on or outside a boundary of a region defined by the second surface, a locus arc, and the lower offset plane, the locus arc being drawn at a position where a tip of the finger of the person inserted through the lower gap from the lower end of the blocking member fails to hold the locus arc.

14. The fence according to claim 10, wherein the blocking member has a second surface facing the outside, the second surface inclining toward the outside as advancing upward from the lower end of the blocking member, and intersecting a vertical plane at an angle smaller than an angle between the lower offset plane and the vertical plane to keep the finger from holding the second surface.

15. The fence according to claim 14, wherein the blocking member has a third surface facing one side, the third surface extending toward the other side as advancing upward from an upper end of the second surface, an inflection edge between the second surface and the third surface being on or outside a boundary of a region defined by the second surface, a locus arc, and the lower offset plane, the locus arc being drawn at a position where a tip of the finger of the person inserted through the lower gap from the lower end of the blocking member fails to hold the locus arc.

* * * * *